US005127509A

United States Patent [19]

Kohlen et al.

[11] Patent Number: 5,127,509

[45] Date of Patent: Jul. 7, 1992

[54] APPARATUS FOR ROTATABLY POSITIONING TEXTILE YARN WINDING TUBES ABOUT THEIR LENGTHWISE AXES WHILE SUPPORTED ON TUBE CARRIERS

[75] Inventors: Helmut Kohlen, Erkelenz; Paul Surkamp, Kempen; Helmuth Hensen, Moenchengladbach, all of Fed. Rep. of Germany

[73] Assignee: W. Schlafhorst AG & Co., Moenchengladbach, Fed. Rep. of Germany

[21] Appl. No.: 714,212

[22] Filed: Jun. 12, 1991

[30] Foreign Application Priority Data

Jun. 15, 1990 [DE] Fed. Rep. of Germany ..... 4019099

[51] Int. Cl.[5] ..... B65G 21/20

[52] U.S. Cl. ..... 198/345.3; 198/379; 198/465.1; 242/35.5 A

[58] Field of Search ..... 198/345.3, 379, 394, 198/465.1, 619, 803.01; 242/35.5 A

[56] References Cited

U.S. PATENT DOCUMENTS

| | | | |
|---|---|---|---|
| 3,901,381 | 8/1975 | Quinn | 198/379 |
| 3,938,653 | 2/1976 | Senger | 198/379 |
| 3,993,199 | 11/1976 | Jokgensen | 198/379 |
| 4,081,072 | 3/1978 | Le Vasseur | 198/394 |
| 4,257,151 | 3/1981 | Coots et al. | 198/379 |
| 4,544,107 | 10/1985 | Matsui et al. . | |
| 4,586,668 | 5/1986 | Mori | 242/35.5 A |
| 4,681,231 | 7/1987 | Ueda et al. | 242/35.5 A |
| 4,681,271 | 7/1987 | Matsui et al. . | |
| 5,033,623 | 7/1991 | Grecksch et al. | 242/35.5 A |

FOREIGN PATENT DOCUMENTS

| | | |
|---|---|---|
| 4011797 | 12/1989 | Fed. Rep. of Germany . |
| 3925987 | 7/1991 | Fed. Rep. of Germany . |
| 52-25139 | 2/1977 | Japan . |

*Primary Examiner*—Joseph E. Valenza
*Attorney, Agent, or Firm*—Shefte, Pinckney & Sawyer

[57] ABSTRACT

An apparatus for automatic rotational positioning of textile yarn winding tubes about their lengthwise axes while being transported on peg-tray tube carriers along a conveyor belt or other transport path includes a positioning station having a pair of rotatable positioning rollers disposed at the station along one side of the transport path at a sufficiently close spacing to one another to prevent passage of the peg trays therebetween. Each peg tray has a base plate whose annular surface is formed of a magnetically attractable material such as iron and at least the upstream one of the positioning rollers is magnetized to selectively exert a magnetic force on the peg trays at controllable intervals. As desired, the downstream positioning roller can also be magnetized.

18 Claims, 6 Drawing Sheets

8
7
4
6
5
23
22
3'
24
21
2
21
25
25'
27
26
32
32
29
33
31
30
34
37
28
35
35'
38
36
25"
25
M
12

44'
44
44"
42
42'
46
43
M
41
1
3
40
45
45'
39
15
3
4
4
2
3'

50
51'
52'

6
49'
47'
48
49
47
15
1
3
3
2
4'
4'
51'
3"
3"
15'
51
52"
52
52'
6

8

5'
4'
51
48
52
2
54
55
55
58
56
52"
53
M
57
57
48'
51'

APPARATUS FOR ROTATABLY POSITIONING TEXTILE YARN WINDING TUBES ABOUT THEIR LENGTHWISE AXES WHILE SUPPORTED ON TUBE CARRIERS

BACKGROUND OF THE INVENTION

The present invention relates to apparatus for transporting textile yarn spinning and like winding tubes while supported on tube carriers of the peg-tray type. More particularly, the present invention relates to an apparatus for rotatably positioning peg-tray-supported yarn tubes about their lengthwise axes during transport thereof.

It has long been known to transport spinning and winding tubes wound with textile yarn by means of individual tube carriers each independently supporting a respective yarn tube for conveying the tubes within a closed transport system connecting one or more textile machines or processing stations with one another (see, for example, Japanese Patent Document No. 52-25 139). One convenient form of tube carrier for this purpose includes a circular disk-like base plate from which extends a coaxial upstanding pin for coaxially supporting a yarn tube on the pin, this type of tube carrier being conventionally referred to as a peg tray.

It is further conventional with yarn tubes wound with yarn at a spinning machine in a cop-type fashion to prepare the tubes for subsequent unwinding transferral of the yarn to another package, such preparation often being performed in a bobbin winding machine or on a transport conveyor extending from the spinning machine to the bobbin winding machine. Such unwinding preparation basically involves locating the trailing end of yarn wound on the tube and placing the yarn end at a defined position on the tube. To perform this preparation process on an automated basis, the yarn tube must be rotated about its longitudinal axis, which may be accomplished in differing manners.

German Offenlegungsschrift DE-OS 32 35 442 discloses such a device wherein the individual yarn tube carrier is positioned by holding elements which prevent rotation of the carrier while a driven friction wheel engages the lower foot end of the wound tube to rotate it on the support pin of the tube carrier. Any yarn windings present at the foot end of the tube are necessarily pinched by the friction wheel which may prevent them from being loosened from the tube. Thus, in order to avoid contact of the friction wheel with the main winding of yarn on the tube, the friction wheel must be of a narrow configuration and its positioning in contact with the tube must be precisely controlled.

German Patentschrift 36 02 002 discloses a yarn end preparation device wherein the base plates of individual yarn tube carriers are driven by means of a rotary plate formed with pockets and rotated in a stepwise manner. This device requires the individual yarn tube carriers to be removed out of their normal path of movement on a transport conveyor and, additionally, this device requires a relatively large amount of space.

German patent application P 39 25 987.0 proposes a yarn end preparation device located directly in the transport path of a tube carrier conveyor wherein three rotatable rollers contact the individual carriers to impart rotary motion thereto. Two of the rollers are located at a sufficiently close spacing to one another at one side of the conveyor transport path to prevent passage of the base plates of the tube carriers between the two rollers. In this device, the positioning of the individual tube carriers as well as the imparting of rotary motion to the tube carriers takes place in a purely mechanical fashion.

SUMMARY OF THE INVENTION

It is an object of the present invention to provide a device for rotational positioning of yarn tube carriers of the general type last above-described which accomplishes rotation and positioning of the individual tube carriers in an improved fashion.

Thus, the present invention basically may be incorporated in any apparatus for rotatably positioning textile yarn winding tubes about their lengthwise axes which comprises a plurality of tube carriers each having a base plate above which an individual yarn tube may be supported in axially upstanding disposition, means defining a path for serial transport therealong of the tube carriers, and a carrier positioning station along the transport path which includes a pair of rotatable positioning rollers disposed along one side of the transport path at a sufficiently close spacing to one another to prevent passage therebetween of the base plates of the tube carriers. According to the present invention, the foregoing object is accomplished by providing each base plate with a magnetically attractable annular surface and providing at least the positioning roller located most upstream in the direction of carrier transport along the transport path with means for selectively exerting a magnetic force at controllable intervals.

The intermittent application of a magnetic force through the upstream roller to act on individual tube carriers traveling along the transport path provides considerably enhanced effectiveness in catching, positioning and rotating each individual tube carrier at the positioning station. Thus, additional elements for stopping the tube carriers as well as additional opposing elements for engaging the tube carriers against the positioning rollers may be eliminated if desired. By driving rotation of the upstream positioning roller, each individual tube carrier may be rotated after magnetic attraction to the positioning roller in the appropriate rotational direction for locating the trailing yarn end on the supported yarn tube as soon as the tube carrier is delivered between the two positioning rollers. As a result, the yarn end may be immediately loosened in some cases or at least a quick transition of the tube carrier and its supported yarn tube into the rotary motion necessary to locate the yarn end can be accomplished without the necessity of overcoming opposing inertial forces acting on the tube carrier.

It may also be desirable in some embodiments to provide the downstream positioning roller with comparable means for selectively exerting a magnetic force at controllable intervals. It is also preferred that both of the positioning rollers be driven, which enables the most reliable transmission of rotary motion by the rollers to the tube carriers to be achieved. Additionally, a common drive means can be provided for both positioning rollers.

In one embodiment, the magnetization of one or both positioning rollers may be accomplished by forming a part of the positioning roller as an iron core positioned within a magnetic coil. This arrangement provides a particularly simple nonmechanical means of magnetizing the rollers. In embodiments wherein both positioning rollers are magnetized, it is preferred that the magnetic coils have differing polarities for generating differing directions of magnetic flux in the positioning rollers. The presence of differing directions of magnetic flux in the rollers amplifies the magnetic forces acting on the individual tube carriers since the lines of magnetic flux run directly through the annular surface of the individual tube carriers, which preferably is in the form of an iron ring, thereby establishing a magnetic bridge between the two positioning rollers.

On the other hand, the possibility is also contemplated of utilizing mechanical means for influencing the application of magnetic force by the rollers to the tube carriers. For example, each magnetized positioning roller may include a first axial portion of a non-magnetic material and a second axial portion comprising a permanent magnet, with a mechanical arrangement being provided for selectively shifting the roller axially to alternately position the first or second axial portions for contact with the base plates of the tube carriers.

It is also contemplated that one or both of the positioning rollers may be supported for selective movement toward and away from the transport path to be movable into and out of an operating position relative to the path. In such embodiments, a retainer is disposed between the positioning rollers to maintain tube carriers on the transport path when the movable roller or rollers is spaced away from the transport path out of the operating position.

Preferably a sensor or sensors are provided at the positioning station, typically between the positioning rollers, to recognize the presence of a tube carrier at the positioning station. The sensor or sensors are, in turn, utilized to control the drive or drives to the positioning rollers as well as the magnetic arrangement thereof in relation to the presence or absence of a tube carrier at the positioning station.

Under ordinary circumstances, the magnetic attraction of a tube carrier at the positioning station to the magnetized positioning rollers will be sufficient to block further traveling movement of following tube carriers along the transport path. Nevertheless, it is contemplated to be advantageous, particularly when the tube carriers are utilized for transporting relatively large yarn tubes, to provide a stop member along the transport path upstream of the upstream positioning roller for selective movement into and out of a position blocking transport of following tube carriers along the transport path. Such stop arrangement may be controlled in response to the aforementioned sensor.

In typical embodiments, the transport path will be defined by a traveling conveyor adapted to support and transport tube carriers. To assist in positioning and maintaining tube carriers on the conveyor, side rails may be provided alongside the conveyor. In certain embodiments, the positioning station may be located between two distinct transport conveyors to serve the dual purpose of rotatably positioning the tube carriers while also transferring them from one conveyor belt to the other, which avoids any necessity of providing a third intermediate conveyor belt at this position.

It may also be advantageous in instances in which the tube carriers are utilized to transport relatively large yarn tubes to provide a third positioning roller, also preferably driven, at a disposition along the opposite side of the transport path from the first-mentioned pair of positioning rollers. In such embodiments, the third positioning roller may be supported for selective movement toward and away from the transport path in relation to the presence and absence, respectively, of a tube carrier at the positioning station. In such cases, the aforementioned stop member may be connected with the third positioning roller for coordinated movement therewith into and out of carrier-blocking position.

DESCRIPTION OF THE PREFERRED EMBODIMENTS

Figure 1:
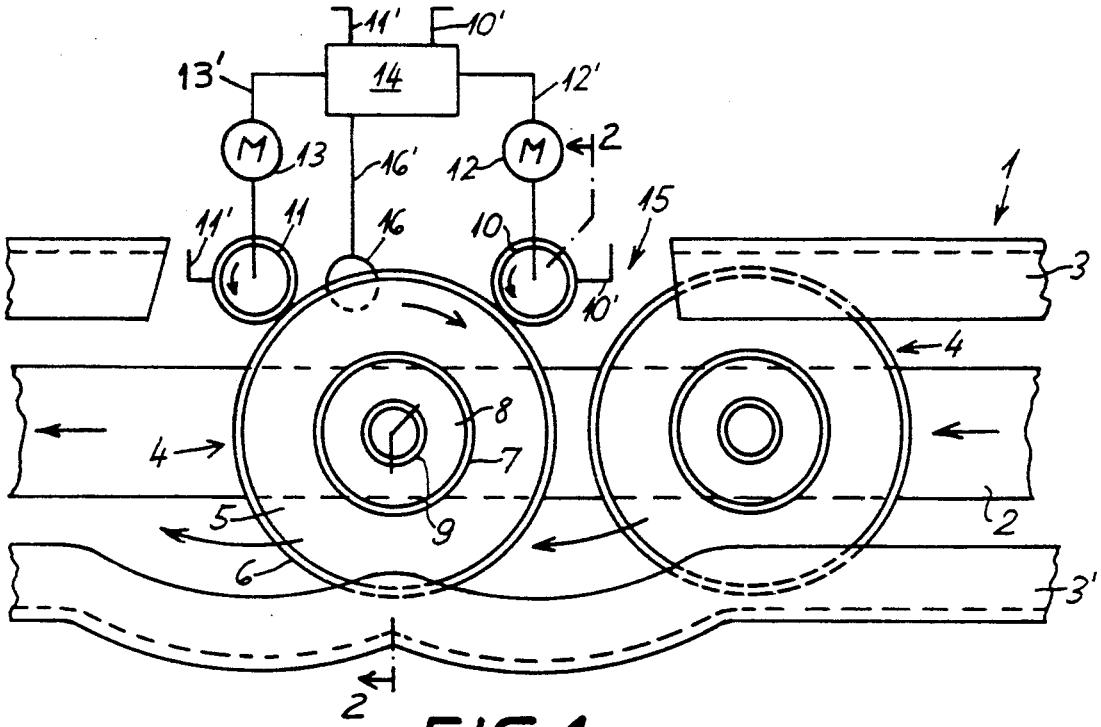
FIG. 1 is a top plan view of a textile yarn tube carrier transport system having a tube positioning station according to one embodiment of the present invention.

Referring now to the accompanying drawings and initially to FIG. 1, a conveyorized textile yarn tube transporting system is shown generally at 1 and basically includes a traveling conveyor belt 2 on which individual yarn tube carriers 4 may be frictionally supported to travel therewith. The tube carriers 4 are of the aforementioned peg-tray type having a circular disk-shaped base plate 5, an integral coaxially-mounted smaller diameter circular collar portion 7, and a support pin 7, extending coaxially from the collar portion 7 for supporting a cop-wound or other similar yarn-wound tube 8 in upstanding coaxial relation on the collar portion 7 with the pin 7, received within the interior of the yarn tube. As will be understood, the transport conveyor belt system is equally usable for transporting peg-tray carriers of the type having only a base plate and a coaxial pin.

The transport system further includes guide rails 3, 3' extending laterally alongside the conveyor belt 2 to assist in retaining peg trays 4 on the conveyor belt 2. The guide rails 3, 3' are preferably of a C-shape configured to receive the base plates 5 of the peg trays 4 to act as a guide therefor in both a vertical and a horizontal direction. In normal operation, the upper surface of the conveyor belt 2 is slightly elevated from the lower surfaces of the guide rails 3, 3' so that the base plates 5 do not rest directly on the guide rails 3, 3' to avoid unnecessary friction therebetween. Elongate support members 21 extend directly beneath the opposite lengthwise edges of the conveyor belt 2 along the length thereof to maintain the belt in a substantially flat horizontal plane of travel.

As shown in FIG. 1, an interruption 15 is formed in the guide rail 3 to accommodate a peg tray positioning station according to the present invention. As more fully explained hereinafter, the positioning station basically includes a pair of driven positioning rollers 10, 11 disposed within the interruption area 15 generally in line with the guide rail 3 to be at substantially the same level as the base plates 5 of peg trays 4 traveling on the conveyor belt 2 for peripheral frictional driving engagement with the base plates 5, the positioning rollers 10, 11 being sufficiently closely spaced to one another along the respective side of the conveyor belt 2 to prevent the base plates 5 of the peg trays 4 from accidentally passing laterally outwardly from the conveyor belt 2 between the positioning rollers 10, 11. The other guide rail 3' is formed with an outward curvature directly opposite each positioning roller 10, 11 laterally across the conveyor belt 2 to accommodate lateral deflection of the base plates 5 of peg trays 4 when passing in peripheral engagement with the positioning rollers 10, 11.

Figure 2:
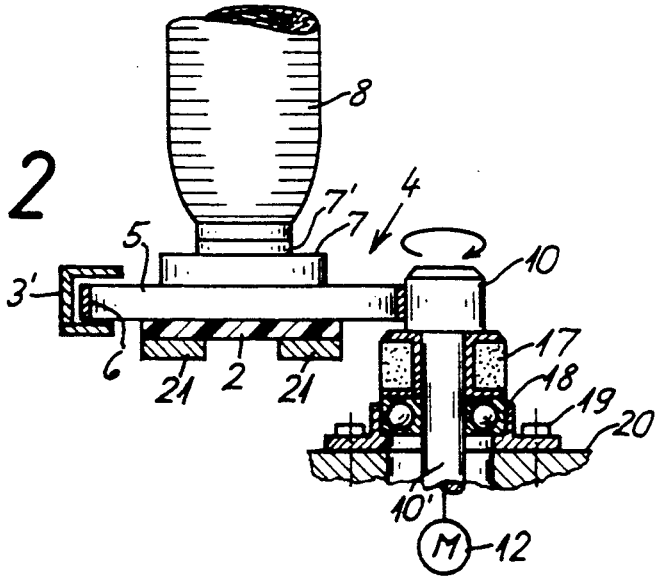
FIG. 2 is a vertical cross-sectional view of the positioning station of FIG. 1, taken along line 2—2 thereof.

According to the present invention, each of the positioning rollers 10, 11 is magnetized and each of the peg trays 4 is equipped with a magnetically attractable surface annularly about its base plate 5 so that the base plate of each peg tray conveyed by the conveyor belt 2 can be magnetically attracted automatically into peripheral contact of its base plate 5 with the upstream-most positioning roller 10 as each peg tray 4 arrives at the positioning station. By way of example but without limitation, each peg tray 4 may be equipped with an iron ring 6 encircling the periphery of its base plate 5 to render it magnetically attractable and the upstream roller 10 may be constructed to form an iron core positioned within an electromagnetic coil such as shown in FIG. 2. More specifically, in such embodiment, the roller 10 includes a downwardly depending integral shaft 10, which extends rotatably through an electromagnetic coil 17 and is rotatably supported therebelow in a suitable bearing 18 affixed via fastening screws 19 to the frame 20 of the transport apparatus. A suitable drive motor, shown only representatively at 12, is connected to the roller shaft 10' for imparting driven rotation thereto. Preferably, the downstream roller 11 is of a similar construction to also be magnetized and driven by a respective drive motor 13 (FIG. 1).

The positioning station may further include a central control unit 14 which is electrically connected via control leads 10', 11' with the respective electromagnetic coils for the rollers 10, 11 and also via control leads 12', 13' with the respective drive motor 12, 13 for the rollers 10, 11, thereby to independently control actuation and deactuation of the roller motors and magnetic coils.

A sensor 16 is arranged at the positioning station between the rollers 10, 11 for detecting the presence thereat of a peg tray base plate 5. The sensor 16 is, in turn, connected to the central control unit 14 via a signalling lead 16,.

In operation, when the positioning station is awaiting arrival of a peg tray 4, the control unit 14 maintains both the magnetic coil 17 and the drive motor 12 associated with the upstream positioning roller 10 in an energized state, while the magnetic coil 17 and the drive motor 13 for the downstream positioning roller 11 are de-energized. Upon arrival of a peg tray 4 at the positioning station, the iron ring 6 on the peg tray's base plate 5 is magnetically attracted into peripheral driven contact with the upstream positioning roller 10 and, as the peg tray 4 continues to travel under the motive force of the conveyor belt 2, the peg tray is delivered into peripheral contact also with the downstream roller 11, thereby automatically positioning the peg tray 4 between the two rollers 10, 11 as shown in FIG. 1. As soon as the sensor 16 detects the presence of the arriving peg tray 4, the central control unit 14 energizes the magnetic coil 17 and the drive motor 13 associated with the downstream roller 11. In this manner, the joint magnetic attraction exerted on the peg tray 4 by the two positioning rollers 10, 11 retains the peg tray 4 against its tendency to continue travel with the conveyor belt 2 and, at the same time, the two rollers 10, 11 impart driving rotation to the peg tray 4 as indicated by the directional arrows in FIG. 1.

A yarn end locating and preparing device (not shown) is provided at the positioning station to locate, loosen and position the trailing end of yarn on the yarn tube supported on the peg tray 4 in a conventional manner. The yarn end locating and preparing device is connected with the central control unit 14 to provide a signal thereto after a predetermined period of time or after completion of the device's operation, whereupon the control unit 14 initiates termination of the positioning operation. For example, at that time, the control unit 14 may reverse the drive motors 12, 13 to reverse the direction of rotation of the positioning rollers 10, 11, in order to wind the located yarn end onto the nose end of the yarn tube. Also, the electromagnetic coil 17 associated with the upstream positioning roller 10 can be deenergized by the central control unit 14 via the control lead 10, to discontinue magnetic attraction of the iron ring 6 of the peg tray 4. Thereupon, the continuing traveling movement of the conveyor belt 2 frictionally acts upon the base plate 5 of the peg tray 4 to transport the peg tray 4 away from the roller 10, which can be accelerated by driving rotation of the downstream positioning roller 11 opposite to its rotational direction shown in FIG. 1 for a predetermined period of time and then de-energizing the magnetic coil 17 associated with the downstream roller 11. Alternatively, the reversal of the drive motor 13 and deenergization of the magnetic coil 17 for the downstream roller 11 may be controlled in relation to detection by the sensor 16 of movement of the peg tray 4 away from the positioning station.

Figure 3:
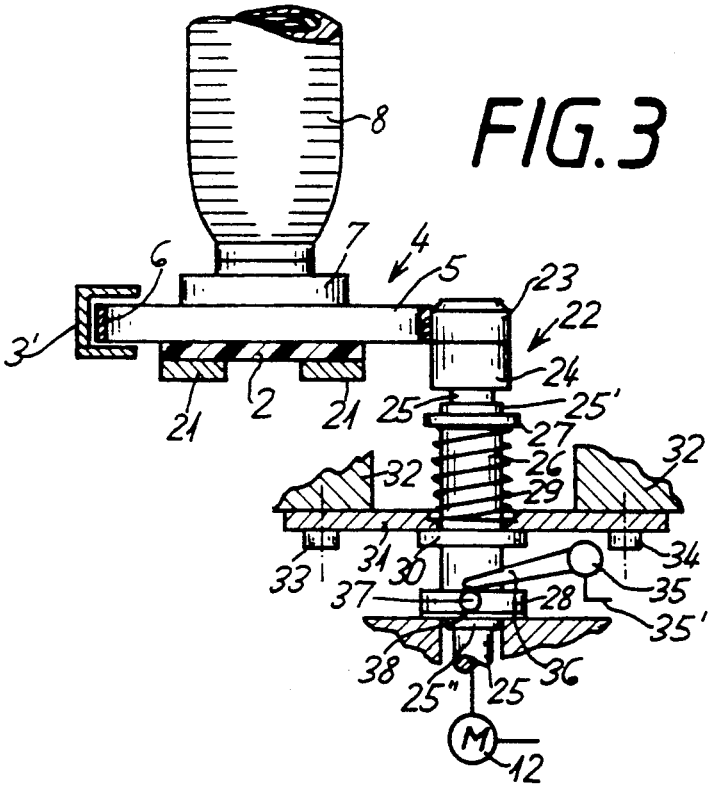
FIG. 3 is another vertical cross-sectional view similar to FIG. 2 of an alternative embodiment of positioning station according to the present invention.

FIG. 3 illustrates an alternative embodiment of positioning roller, broadly indicated at 22, which may be used instead of the rollers 10, 11 in FIG. 1. In this embodiment, the magnetic force is generated by a permanent magnet rather than an electromagnetic device. Specifically, the roller 22 comprises an upper axial portion 23 formed of a non-magnetic material, such as plastic, and a lower axial portion 24 formed of a permanently magnetic material. The roller 22 has a coaxial depending shaft 25 which is connected with a mechanical actuating arrangement, described below, for selectively shifting the roller 22 vertically along its axis to alternately position the upper and lower axial portions 23, 24 at the level of the base plates 5 of peg trays 4 traveling along the conveyor belt 2 for selective alternative contact of the axial portions 23, 24 with the annular iron ring 6 on the peg tray base plates 5. In this manner, the magnetic force of the permanently magnetic axial portion 24 is active only when the roller 22 is shifted upwardly.

The depending shaft 25 of the roller 22 is rotatably supported in a sleeve 26 which has upper and lower flanges 27, 28 held between spring rings 25', 25" on the shaft 25. A coil spring 29 extends coaxially about the sleeve 26 between the upper flange 27 and a retaining plate 31 affixed to the transport system frame 32 by fastening screws 33, 34, the spring 29 thereby serving to urge the sleeve 26 and, in turn, the roller shaft 25 and the roller 22 upwardly. A pivoting fork-shaped actuation arm 36 is controlled by a solenoid 35 to act downwardly against pins 37 extending outwardly from diametrically opposite sides of the flange 28 to shift the sleeve 26, the roller shaft 25 and the roller 22 downwardly against the biasing force of the spring 29. The extent of upward and downward shifting movement of the sleeve 26 is defined by an upper stop ring 30 affixed to the underside of the retaining plate 31 and a lower stop ring 38 affixed to a downwardly spaced portion of the frame 32. The roller shaft 25 is operatively connected to a drive motor 12 for driving rotation of the roller 22 within the supporting sleeve 26.

Figure 4:
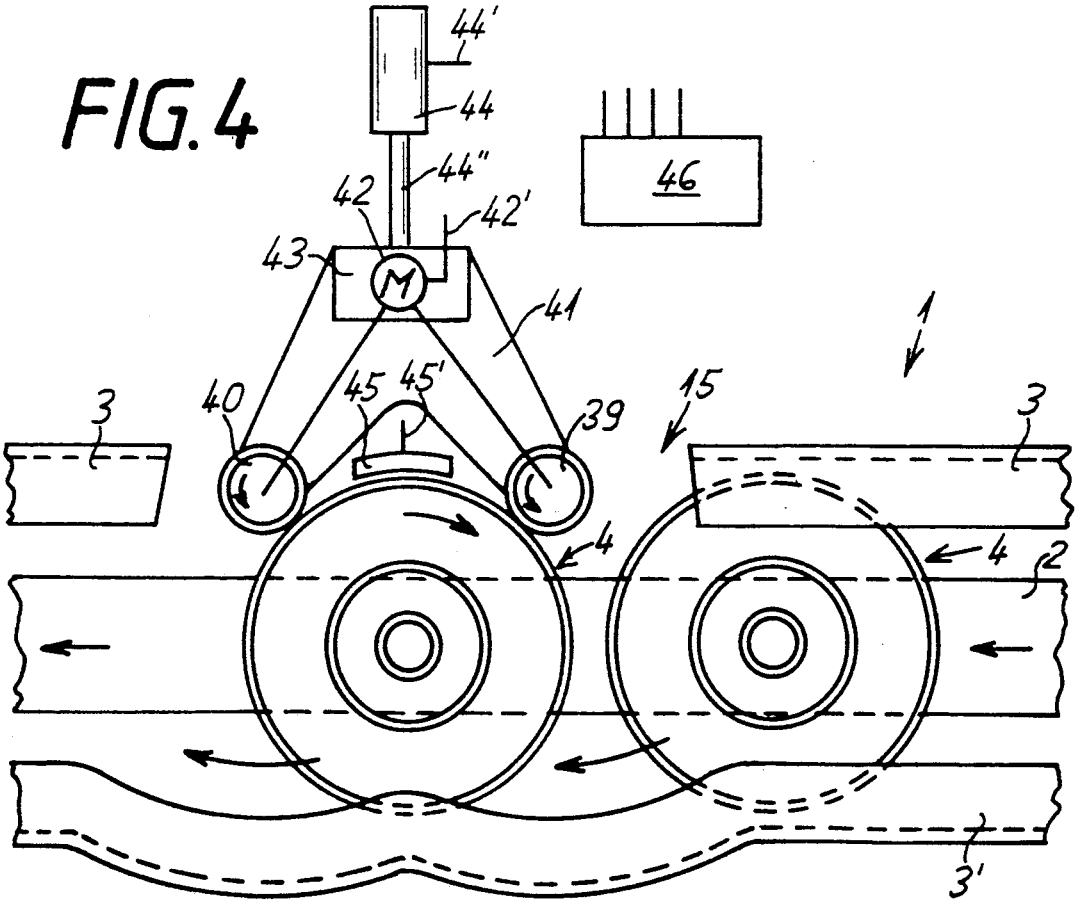
FIG. 4 is another top plan view similar to FIG. 1 of a textile yarn tube carrier transport system having a tube positioning station according to another embodiment of the present invention.

FIG. 4 illustrates another embodiment of positioning station according to the present invention, similar to that of FIG. 1. In this embodiment, positioning rollers 39, 40 each formed of a permanently magnetic material, are rotatably supported by a common carrier plate 41 which can be horizontally shifted toward and away from the conveyor belt 2 by a hydraulic cylinder 44 whose reciprocal piston 44" is connected to the carrier plate 41. A drive motor 42 is supported on the carrier plate 41 for selectively driving the positioning rollers 39, 40 individually or in common via a drive transmission 43, shown only schematically. As those persons skilled in the art will recognize, such a common drive for a pair of positioning rollers located at one longitudinal side of the transport conveyor belt 2 can be provided in any other embodiment of the present invention.

The embodiment of FIG. 4 further provides a retention element 45 disposed at a stationary location between the positioning rollers 39, 40 to prevent laterally outward movement of peg trays 4 from the conveyor belt 2 when the positioning rollers 39, 40 are shifted away from the conveyor belt 2. The retention element 45 can also be equipped with a sensor for detecting the presence of a peg tray 4 at the positioning station, which sensor can be connected via a suitable signaling lead 45, to a central control unit 46.

At the point in operation of the transport system shown in FIG. 4, the carrier plate 41 and its supported positioning rollers 39, 40 are shifted toward the conveyor belt 2 into operative disposition wherein the rollers 39, 40 have magnetically attracted and are rotating a peg tray 4 at the positioning station. After completion of the yarn end preparation operation to be performed on the yarn tube supported by such peg tray 4, the central control unit 46 actuates the hydraulic cylinder 44 via a control lead 44' to retract the piston 44" and the carrier plate 41 away from the conveyor belt 2. The retention element 45 prevents the peg tray 4 from moving laterally with the positioning rollers 39, 40, thereby separating the peg tray 4 from the magnetic force of the positioning rollers 39, 40 whereupon the peg tray 4 resumes movement under the traveling force of the conveyor belt 2 to be transported away from the positioning station.

The next following peg tray 4 on the conveyor belt 2 is then permitted to be transported to the positioning station, whereupon its arrival is detected by the retention element 45 and signaled via lead 45' to the central control unit 46. The control unit 46 then actuates the hydraulic cylinder 44 to extend its piston 44" and thereby return the carrier plate 41 and the positioning rollers 39, 40 toward the conveyor belt 2 into operative disposition to magnetically attract and rotationally drive the newly arriving peg tray 4, to facilitate performance of a yarn end preparation operation on its supported yarn tube.

As can be seen from FIG. 4, when the carrier plate 41 is moved toward the conveyor belt 2 into its operative disposition, the positioning rollers 39, 40 are disposed sufficiently more closely to the conveyor belt 2 than the retention element 45 to prevent engagement of the peg tray 4 with the retention element so that the retention element 45 does not hinder rotary motion of the peg tray 4 under the driving force of the rollers 39, 40.

Figure 5:
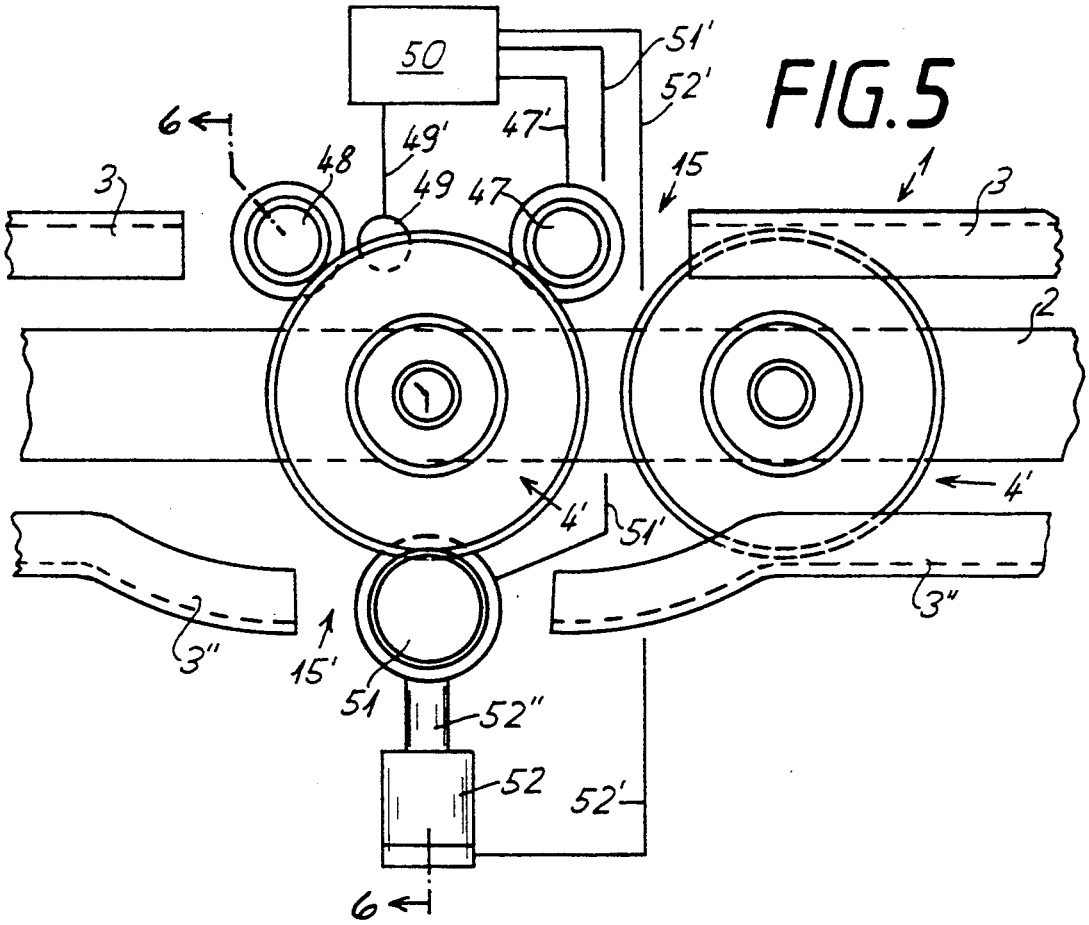
FIG. 5 is another top plan view similar to FIG. 1 of a textile yarn tube carrier transport system having a tube positioning station according to another embodiment of the present invention.
Figure 6:
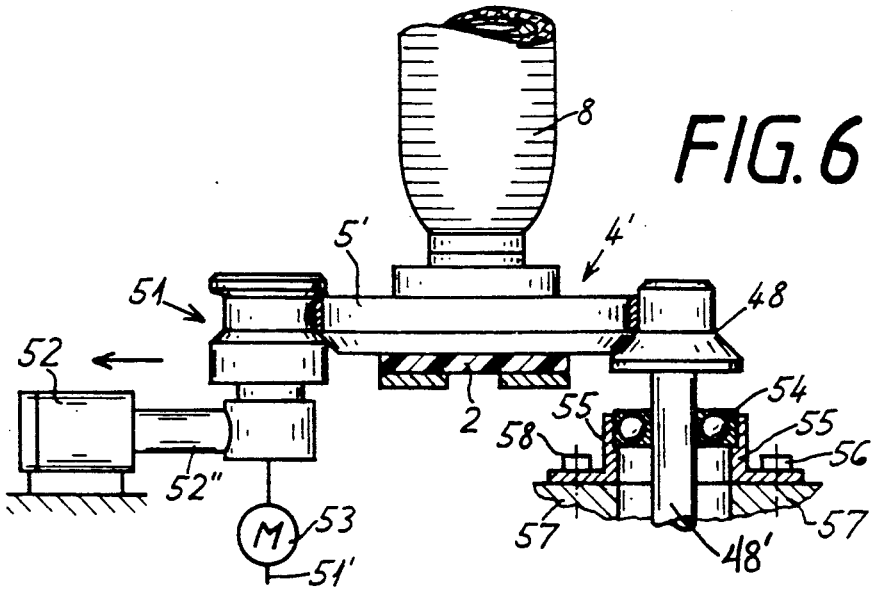
FIG. 6 is a vertical cross-sectional view of the tube positioning station of FIG. 5, taken along line 6—6 thereof.

The positioning station in the embodiment of FIGS. 5 and 6 is particularly adapted for handling peg trays supporting relatively large spinning tubes, i.e., tubes wound with a relatively large mass of yarn. More specifically, the positioning station in FIG. 5 is generally similar to that of FIG. 1, having two positioning rollers 47, 48 longitudinally spaced from one another within an interruption 15 along one side of the conveyor belt 2, with the addition of a third positioning roller 51 directly laterally opposite the positioning rollers 47, 48 at the other longitudinal side of the conveyor belt 2. In this manner, the three positioning rollers 47, 48, 51 cooperatively engage the periphery of the base plate 5' of a peg tray 4' at the positioning station, the additional positioning roller 51 insuring proper driven engagement of the base plate 5' with the positioning rollers 47, 48.

In order to accommodate the third positioning roller 51, the guide rail 3" at the corresponding side of the conveyor belt 2 is formed with an interruption 15, wherein the positioning roller 51 is situated. As best seen in FIG. 6, each of the positioning rollers 47, 48, 51 are provided with annular flanges to promote reliable guidance and positioning of the base plates 5' of peg trays 4' at the positioning station. As seen in FIG. 6, the base plates 5' of the peg trays 4' utilized in this embodiment have an annular bevel formed in the underside thereof, the annular flanges of each positioning roller 47, 48, 51 being tapered in correspondence to such bevel. This configuration of the peg tray base plates provides the advantage of enabling them to overcome rough areas in the transport system with minimal problems.

In this embodiment, it is preferred that the upstream positioning roller 47 may be of substantially the same driven and magnetized construction as the upstream positioning roller 10 of FIGS. 1 and 2 or the positioning roller 22 of FIG. 3, but it is preferred that positioning roller 48 be non-magnetized to exert no magnetic force on peg trays 4, at the positioning station. Thus, as shown in FIG. 6, the positioning roller 48 has its depending shaft 48' supported only in a ball bearing 54 affixed by a bracket 55 and fastening screws 56, 58 to the frame 57 of the transport conveyor system. The primary function of the upstream positioning roller 47 is to magnetically attract and catch each arriving individual peg tray 4' which then rolls about the periphery of the upstream positioning roller 47 into simultaneous peripheral engagement with the downstream positioning roller 48. An intervening sensor 49 is provided to detect the presence of a peg tray 4' between the positioning rollers 47, 48, the sensor 49 in turn signaling the presence of a peg tray 4' to a central control unit 50 via a signaling lead 49'. The opposing third positioning roller 51 is mounted rotatably to the projecting end of a piston 52' movable within a hydraulic cylinder 52 toward and away from the conveyor belt 2. The central control unit 50 is connected via a control lead 52' to the hydraulic cylinder 52 to actuate extension of the piston 52' to move the positioning roller 51 into operative position for peripheral engagement with a peg tray 4' only when the presence of a peg tray 4' at the positioning station has been detected by the sensor 49.

It is also contemplated to be possible in this embodiment to drive only the third positioning roller 51. For this purpose, the positioning roller 51 is connected to a drive motor 53, shown in FIG. 6, which also is actuated and de-actuated under the control of the central control unit 50 via another control lead 51'.

Figure 7:
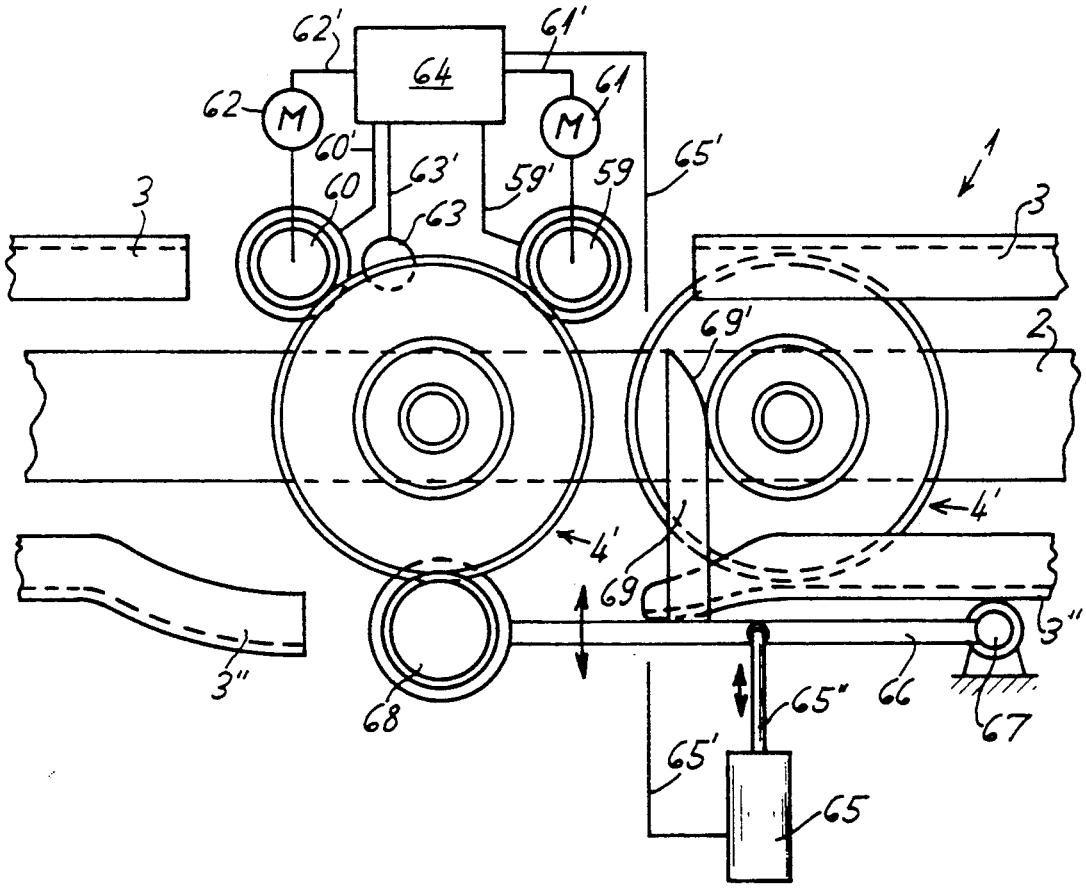
FIG. 7 is another top plan view similar to FIG. 1 of a textile yarn tube carrier transport system having a tube positioning station according to another embodiment of the present invention.

FIG. 7 depicts another embodiment of the present invention which is a variation of the embodiment of FIGS. 5 and 6. More specifically, in this embodiment, a pair of positioning rollers 59, 60 are provided at spacings from one another along one side of the conveyor belt 2 with a third positioning roller 68 being situated directly opposite therefrom at the other side of the conveyor belt 2. The positioning rollers 59, 60 are both driven while the positioning roller 68 is not driven. Each of the positioning rollers 59, 60, 68 are provided with annular flanges to accommodate peg trays 4' having beveled base plates as depicted in FIG. 6. Otherwise, the positioning rollers 59, 60 are substantially identical to the positioning rollers 10, 11 of FIG. 1 with respect to their mounting, drive connection and magnetic coil arrangement. The magnetic coils to each positioning roller 59, 60 are controlled via respective control leads 59', 60' from a central control unit 64. Likewise, the positioning rollers 59, 60 are provided with respective drive motors 61, 62 which are also controlled via similar separate control leads 61', 62', respectively, from the central control unit 64. A sensor 63 is provided between the positioning rollers 59, 60 to signal the presence or absence of a peg tray 4' to the central control unit 64 via a signaling lead 63'.

The opposing third positioning roller 68 is mounted at the end of a pivot lever 66 extending generally lengthwise of the conveyor belt 2 for pivoting movement about a pivot mounting 67. Pivotal movement of the lever 66 is actuated by a hydraulic cylinder 65 whose extending piston 65'' is attached intermediately along the length of the pivot lever 66. The hydraulic cylinder 65, in turn, is controlled by the central control unit 64 via a control lead 65' to pivot the lever 66 toward and away from the conveyor belt 2. A stop member 69 is affixed to the pivot lever 66 to extend toward the conveyor belt 2 into overlying relation therewith. Thus, when the hydraulic cylinder 65 is actuated by the control unit 64 to pivot toward the conveyor belt 2, the positioning roller 68 is disposed to peripherally engage the base plate 5' of a peg tray 4, at the positioning station simultaneously with the positioning rollers 59, 60, while the stop member 69 extends into the peg tray transport path of the conveyor belt 2 to block passage of the following peg trays 4' on the conveyor belt 2. Preferably, the stop member 69 is formed with a tapered outward end 69, whose configuration is thereby effective to engage and push backwards against the direction of travel of the conveyor belt 2 any closely following peg tray 4' which may have already struck the preceding peg tray 4' disposed at the positioning station, thereby to avoid undesirable contact between the two peg trays 4' during rotary positioning movement of the individual peg tray 4' at the positioning station.

Figure 8:
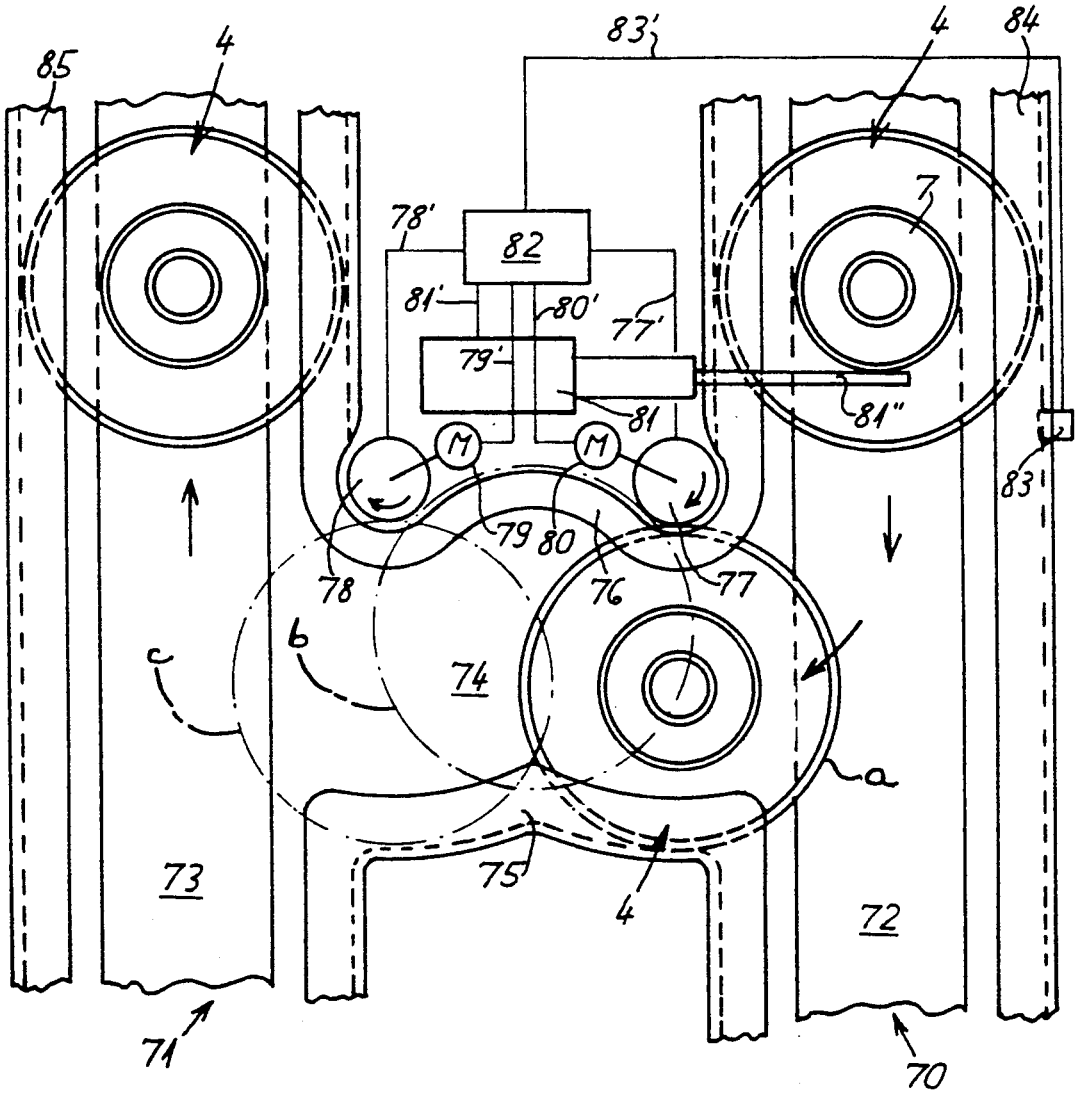
FIG. 8 is a top plan view of another form of textile yarn tube carrier transport system with two parallel transport conveyors, having a tube positioning station according to another embodiment of the present invention located between the parallel conveyors.
Figure 9:
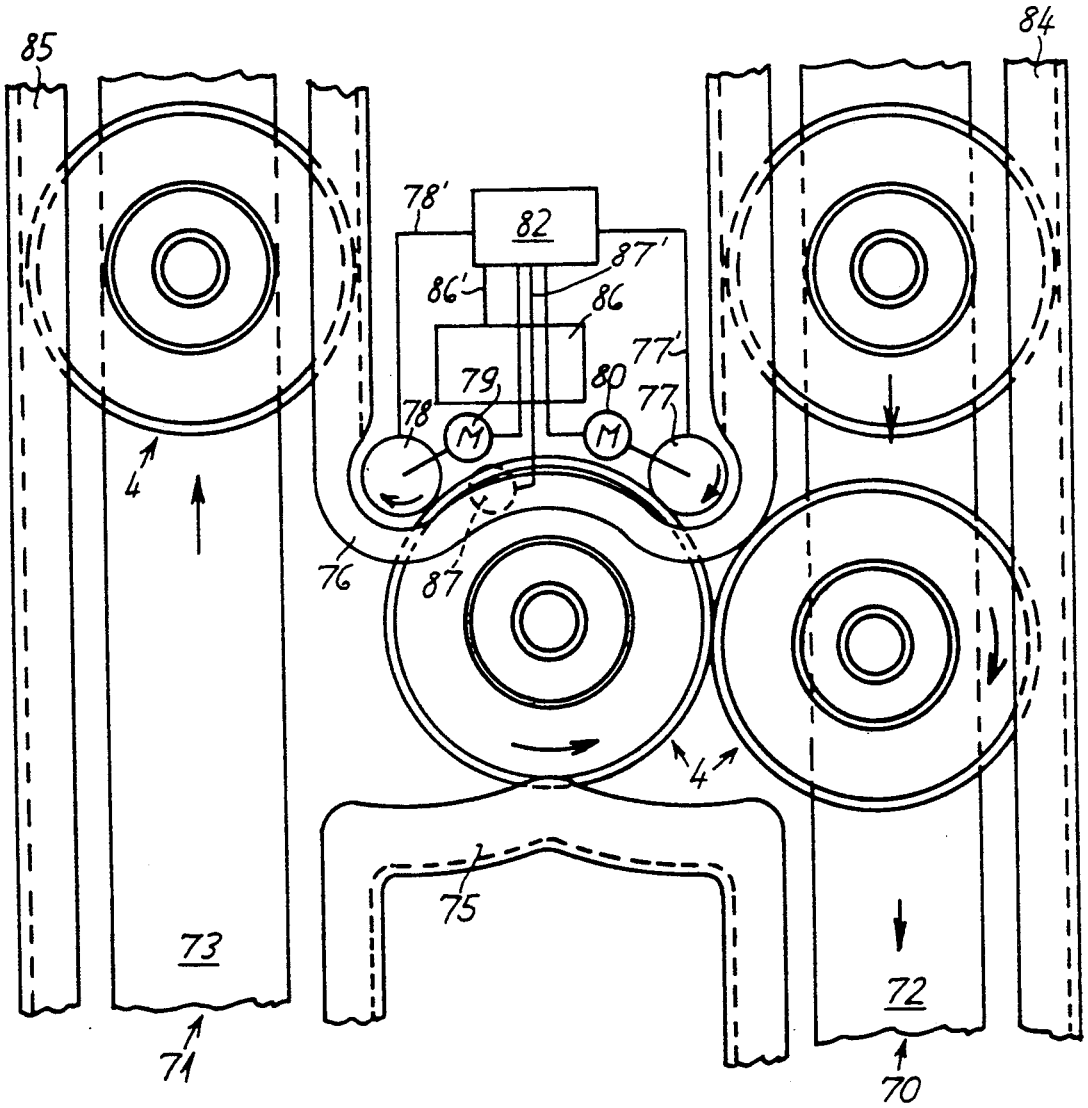
FIG. 9 is a top plan view similar to FIG. 8 showing an alternative embodiment of tube positioning station according to the present invention located between parallel transport conveyors.

The embodiments of FIGS. 8 and 9 show variations of the present invention wherein the positioning station is located between two separate peg tray transport paths 70, 71 defined by respective traveling conveyor belts 72, 73. In each case, the conveyor belts 72, 73 travel in parallel spaced relation in opposite directions. The positioning station in each case is defined between spaced slide rails 75, 76 extending transversely between the conveyor belts 72, 73.

In the embodiment of FIG. 8, a sensor 83 is mounted to a guide rail 84 extending along the transport path 70 at a location immediately upstream of the positioning station. The positioning station is equipped with a central control unit 82 which is operatively connected with the sensor 83 through a signaling lead 83'. The sensor 83 is mounted to the guide rail 84 at the same elevation as the collar portion 7 of peg trays 4 traveling along the associated conveyor belt 72. The sensor 83 may be of any suitable type, such as a photosensor associated with a light reflector (not shown) mounted at the opposite side of the transport path 70.

A stop assembly 81 having a selectively extendable and retractable stop member 81'' is mounted along the transport path 70 at a location slightly upstream of the sensor 83. The stop member 81'' may be magnetized to exert a magnetically attractive force to the annular iron rings 6 on peg trays 4 traveling along the conveyor belt 72. The design of such a magnetically-acting stop arrangement is described in German patent application P 40 11 797.9, which is incorporated herein by reference.

In operation, when a peg tray 4 is transported by the conveyor belt 72 past the sensor 83, the collar portion of the peg tray 4 interrupts the light beam generated by the sensor which causes a signal to be transmitted along signaling lead 83' to the central control unit 82. In turn, the control unit 82 transmits an instruction signal to the actuation device 81 by the control lead 81' to cause the stop member 81'' to be extended into the transport path 70 sufficiently to engage the collar portion of the next following peg tray 4 on the conveyor belt 72, thereby to block further passage of peg trays 4. After a relatively brief predetermined period of time set in accordance with the normal time required for yarn end preparation of a spinning tube 8 on a peg tray 4 at the positioning station, the central control unit 82 signals the actuation device 81 to withdraw the stop member 81'' out of the transport path 70 until the sensor 83 detects the passage of the next following peg tray 4.

As those persons skilled in the art will readily recognize, this embodiment of the present invention can also be utilized with peg trays 4 of the type which are not equipped with an annular collar portion 7. In such cases, the sensor 83 may be arranged at the elevation of the foot portion 7' of spinning tubes 8 supported on the peg trays, or any other suitable alternative means of detecting passage of peg trays 4 may be utilized.

The positioning station in the embodiment of FIG. 8 is equipped with a pair of positioning rollers 77, 78 arranged at spacings from one another along the slide rail 76. Each of the positioning rollers 77, 78 is magnetized and rotatably supported in substantially the same manner as above-described for the positioning roller 10 of FIG. 1., i.e., each includes a downwardly extending shaft supported coaxially by a magnetic coil to form its iron core. Each magnetic coil is controlled by the central control unit 82 through respective control leads 77', 78'. Each positioning roller 77, 78 is also independently driven by a respective drive motor 80, 79, controlled through respective leads 80', 79' by the central control unit 82.

After an individual peg tray 4 passes the sensor 83' on the transport path 70, the peg tray's annular iron ring 6 is attracted by the magnetized upstream positioning roller 77 into peripheral contact therewith and the peg tray 4 then rolls about the periphery of the roller 77 onto the slide tracks 75, 76, as indicated at position a in FIG. 8. The traveling movement of the conveyor belt 72 as well as the driven rotation of the positioning roller 77 cooperate to impart such movement to the peg tray 4 to assist it in entering the positioning station. The slide rails 75, 76 are preferably designed in a C-shape, as are the slide rails 84, 85 along the transport paths 70, 71, as aforedescribed for the guide rails 3, 3' of FIG. 1.

The individual peg tray 4 continues to move from the transport path 70 along the slide rails 75, 76 into an operative position b, shown in broken lines in FIG. 8, between the two positioning rollers 77, 78, with its base plate 5 in simultaneous peripheral contact with each roller. To assist in such positioning of the peg tray 4, the magnetic coil of the downstream positioning roller 78 is also energized to attract the annular iron ring of the peg tray 4. In this position of the peg tray 4, the driven positioning rollers 77, 78 impart rotary motion to the peg tray 4 for purposes of performing the aforementioned yarn end preparation operation by a suitable associated mechanism (not shown) also located at the positioning station.

After termination of the yarn end preparation operation, determined either by the elapse of a pre-established time cycle or by a yarn recognition sensor (not shown), the central control unit 82 first de-energizes the magnetic coil associated with the upstream positioning roller 77. As a result, only the magnetic force of attraction exerted by the downstream positioning roller 78 acts on the peg tray 4, which causes the peg tray 4 to move about the periphery of the downstream roller 78 into the exit position c, also shown in broken lines in FIG. 8, wherein a portion of the peg tray's base plate 5 overlies the conveyor belt 73. In this position, the traveling movement of the conveyor belt 73 imparts additional movement of the peg tray 4 in the direction of belt travel to continue to cause the peg tray 4 to move about the periphery of the downstream roller 78, resulting ultimately in positioning of the peg tray 4 completely on the conveyor belt 73. After a predetermined period of time elapses or after a sensor (not shown) detects final positioning of the peg tray 4 on the conveyor belt 73, the central control unit 82 de-energizes the magnetic coil associated with the downstream roller 78 temporarily to release the peg tray 4 from the magnetic attraction of the downstream roller 78.

The embodiment of FIG. 9 is substantially similar to that of FIG. 8 except that this embodiment does not include a sensor 83 or a stop mechanism 81 along the transport path 70 upstream of the positioning station. Instead, if a peg tray 4 is disposed in the operative yarn end preparation position b between the positioning rollers 77, 78 under the magnetic force of attraction exerted by the positioning rollers 77, 78, the following peg trays 4 transported on the conveyor belt 72 encounter the peripheral surface of the base plate of such peg tray, which prevents the following peg trays from entering the positioning station and instead to continue to travel along the transport path 70 under the motive force of the conveyor belt 72. This arrangement makes it possible to automatically distribute peg trays 4 traveling along the conveyor belt 72 to multiple tube positioning stations located between the transport paths 70, 71 at spacings therealong.

In the embodiment of FIG. 9, a sensor 87 is provided at the positioning station between the positioning rollers 77, 78 for detecting the presence or absence of a peg tray 4 in the operative tube preparation position between the rollers 77, 78 and, in turn, to signal the central control unit 82 via the signaling lead 87'. In this manner, the central control unit 82 is enabled to determine when a peg tray 4 exits the tube preparation station so that, thereupon, the control unit 82 can re-energize the magnetic coil associated with the upstream positioning roller 77 via the control lead 77' in order to be ready to attract the next arriving peg tray 4 on the conveyor belt 72 to deliver it into the tube preparation station.

In each of the aforedescribed embodiments of the present invention wherein both positioning rollers located along the same side of the peg tray transport path are magnetized to attract peg trays 4, it is contemplated to be particularly advantageous to provide each magnet with a differing polarity to generate differing directions of magnetic flux in the positioning rollers, which enables the annular iron ring 6 of each individual peg tray 4 to form a bridge for the magnetic flux lines when located between the positioning rollers. As a result, the magnetic force exerted on the iron ring is distinctly increased.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

We claim:

1. Apparatus for rotatably positioning textile yarn winding tubes about their lengthwise axes, comprising a plurality of tube carriers, each said carrier having a base plate above which an individual yarn tube may be supported in axially upstanding disposition, means defining a path for serial transport therealong of said tube carriers, and a carrier positioning station located along said transport path, said positioning station including a pair of rotatable positioning rollers disposed along one side of said transport path at a sufficiently close spacing to one another to prevent passage therebetween of said base plates of said tube carriers, each said base plate having a magnetically attractable annular surface and at least the one of said pair of positioning rollers located upstream in the direction of carrier transport along said transport path having means for selectively exerting a magnetic force at controllable intervals.

2. Apparatus for rotatably positioning textile yarn winding tubes about their lengthwise axes according to claim 1 and characterized further in that the downstream one of said pair of positioning rollers includes means for selectively exerting a magnetic force at controllable intervals.

3. Apparatus for rotatably positioning textile yarn winding tubes about their lengthwise axes according to claim 1 and characterized further in that said at least one positioning roller comprises an iron core positioned within a magnetic coil.

4. Apparatus for rotatably positioning textile yarn winding tubes about their lengthwise axes according to claim 2 and characterized further in that each said positioning roller comprises an iron core positioned within a magnetic coil.

5. Apparatus for rotatably positioning textile yarn winding tubes about their lengthwise axes according to claim 4 and characterized further in that said magnetic coils have differing polarities for generating differing directions of magnetic flux in said positioning rollers.

6. Apparatus for rotatably positioning textile yarn winding tubes about their lengthwise axes according to claim 1 and characterized further in that said at least one positioning roller comprises a first axial portion of a non-magnetic material and a second axial portion comprising a permanent magnet, and further comprising means for selectively shifting said roller axially for alternately positioning said first and second axial portions for contact with said base plates of said tube carriers.

7. Apparatus for rotatably positioning textile yarn winding tubes about their lengthwise axes according to claim 2 and characterized further in that each said positioning roller comprises a first axial portion of a non-magnetic material and a second axial portion comprising a permanent magnet, and further comprising means for selectively shifting each said roller axially for alternately positioning said first and second axial portions for contact with said base plates of said tube carriers.

8. Apparatus for rotatably positioning textile yarn winding tubes about their lengthwise axes according to claim 1 and characterized further by means for moving said at least one positioning roller toward and away from said transport path for movement into and out of an operating position relative thereto, and means disposed between said pair of positioning rollers for retaining carriers on said transport path when said one positioning roller is moved away from said transport path out of said operating position.

9. Apparatus for rotatably positioning textile yarn winding tubes about their lengthwise axes according to claim 2 and characterized further by means for moving each said positioning roller toward and away from said transport path for movement into and out of an operating position relative thereto, and means disposed between said pair of positioning rollers for retaining carriers on said transport path when said position of rollers are moved away from said transport path out of said operating position.

10. Apparatus for rotatably positioning textile yarn winding tubes about their lengthwise axes according to claim 1 and characterized further by means for driving rotation of at least one of said positioning rollers, means disposed between said pair of positioning rollers for sensing the presence of a tube carrier, and means for controlling said driving means in response to said sensing means.

11. Apparatus for rotatably positioning textile yarn winding tubes about their lengthwise axes according to claim 1 and characterized further by means disposed in said transport path upstream of said upstream positioning roller for sensing the presence of a tube carrier and means for controlling said magnetic force exerting means in response to said sensing means.

12. Apparatus for rotatably positioning textile yarn winding tubes about their lengthwise axes according to claim 11 and characterized further by stop means disposed along said transport path upstream of said upstream positioning roller for movement into and out of a position blocking transport of said tube carriers along said transport path and means for controlling said stop means in response to said sensing means.

13. Apparatus for rotatably positioning textile yarn winding tubes about their lengthwise axes according to claim 1 and characterized further in that said transport path defining means comprises a conveyor for transporting said tube carriers along said transport path.

14. Apparatus for rotatably positioning textile yarn winding tubes about their lengthwise axes according to claim 13 and characterized further by side rails extending alongside said conveyor.

15. Apparatus for rotatably positioning textile yarn winding tubes about their lengthwise axes according to claim 1 and characterized further by another positioning roller disposed along the opposite side of said transport path from said pair of positioning rollers.

16. Apparatus for rotatably positioning textile yarn winding tubes about their lengthwise axes according to claim 15 and characterized further by means for driving rotation of said another positioning roller.

17. Apparatus for rotatably positioning textile yarn winding tubes about their lengthwise axes according to claim 15 and characterized further by means for selectively moving said another positioning roller toward and away from said transport path in relation to the presence and absence, respectively, of a tube carrier.

18. Apparatus for rotatably positioning textile yarn winding tubes about their lengthwise axes according to claim 17 and characterized further by stop means for movement into and out of a position for blocking transport of said tube carriers along said transport path and means connecting said stop means with said means for moving said another positioning roller.

* * * * *